United States Patent [19]

Been

[11] Patent Number: 4,641,680

[45] Date of Patent: Feb. 10, 1987

[54] WASTE SOLVENT RECEPTACLE

[75] Inventor: Thomas S. Been, Saratoga, Calif.

[73] Assignee: Process and Cryongenic Services, Inc., San Jose, Calif.

[21] Appl. No.: 768,896

[22] Filed: Aug. 23, 1985

[51] Int. Cl.[4] ..... E03B 3/40; F16K 31/02

[52] U.S. Cl. ..... 137/312; 137/392; 141/86; 141/198; 4/321; 4/619; 4/625; 222/108

[58] Field of Search ..... 4/321, 323, 619, 625, 4/630; 137/312, 392, 577, 587, 589; 141/86, 198, 369; 222/108, 110, 111, 65

[56] References Cited

U.S. PATENT DOCUMENTS

| | | | |
|---|---|---|---|
| 1,038,021 | 9/1912 | Summers | 222/108 |
| 1,646,898 | 10/1927 | Byrne | 222/108 |
| 1,979,604 | 11/1934 | Burdge | 222/108 |
| 2,520,380 | 8/1950 | Wegman | 222/108 |
| 3,069,671 | 12/1962 | Taylor | 137/312 |
| 3,473,553 | 10/1969 | Collins | 137/312 |
| 4,336,620 | 6/1982 | Gresh | 4/619 |
| 4,541,446 | 9/1985 | Hogan | 137/392 |

FOREIGN PATENT DOCUMENTS

| | | | |
|---|---|---|---|
| 362903 | 3/1921 | Fed. Rep. of Germany | 4/625 |
| 26572 | of 1898 | United Kingdom | 222/110 |

*Primary Examiner*—George L. Walton

*Attorney, Agent, or Firm*—Townsend and Townsend

[57] ABSTRACT

An assembly for collecting and disposing of waste solvents in a manner to meet safety requirements of municipalities. The assembly includes a waste tank and an open-top container for receiving and supporting the waste tank. The container has a greater internal volume that does the waste tank so that, when the waste tank is in the container, a space surrounds the waste tank. Such space is adapted to receive and trap any leakage or overflow of the solvent from the waste tank during use of the assembly. The waste tank has a first port for receiving waste solvent and a second port for allowing the waste solvent to be pumped out of the waste tank. Liquid level sensors are provided on the waste tank for sensing the solvent therein at different levels. The container has brackets for positioning the waste tank on the bottom of the container, and the container has casters to allow the assembly to be easily shifted from place to place.

7 Claims, 6 Drawing Figures

FIG.1
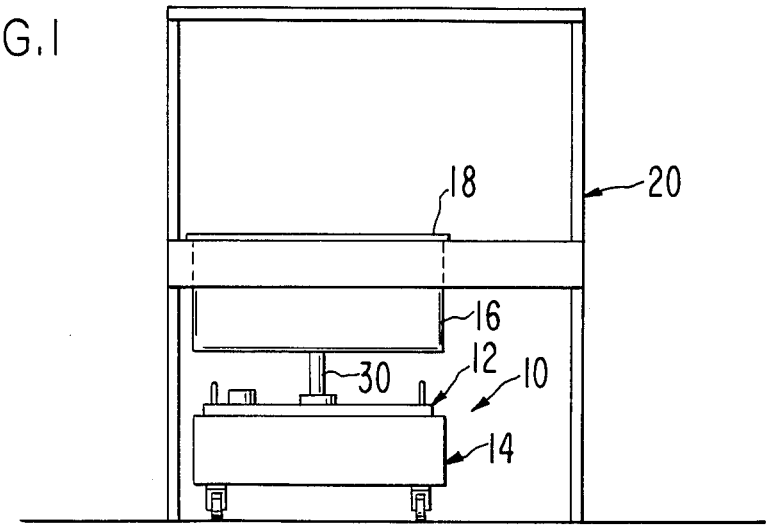
FIG.2
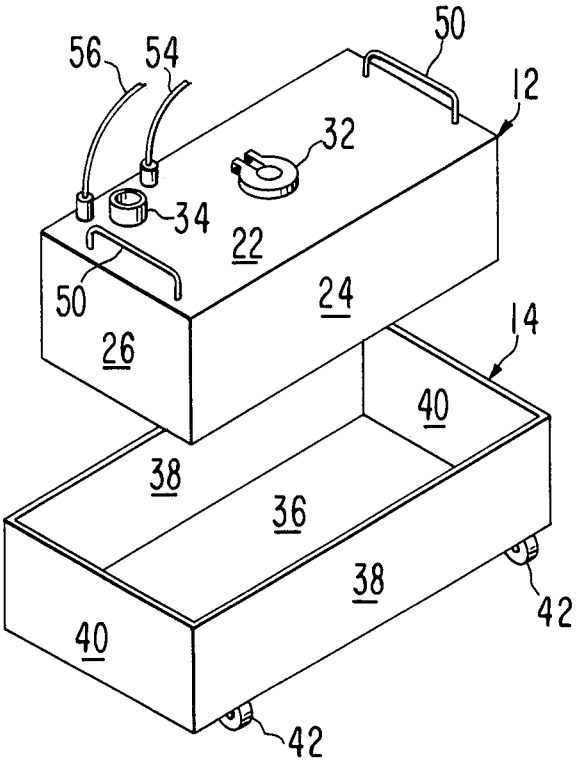
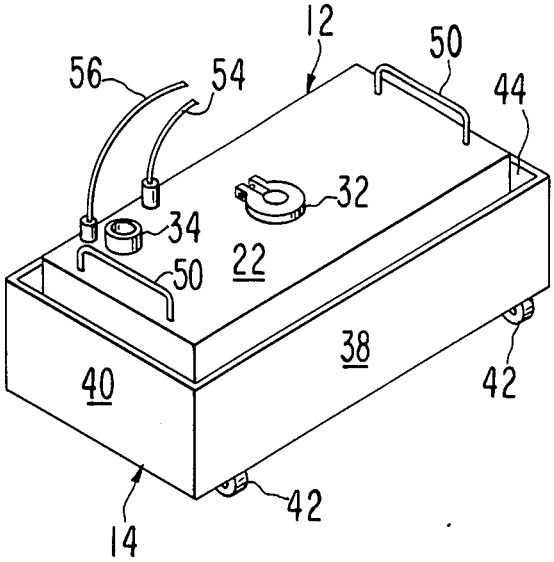
FIG.3

WASTE SOLVENT RECEPTACLE

This invention relates to improvements in the handling of waste solvents which are corrosive to many different materials and, more particularly, to a waste solvent receptacle for receiving and containing waste solvents.

BACKGROUND OF THE INVENTION

Many cities throughout the country now have ordinances or codes which require that waste solvents be disposed of in a manner such that the solvents do not spill onto the floor and onto adjacent operating equipment, and the solvents must not contact the skin or be breathed in by operating personnel. The purpose of these requirements is to provide a safety factor and protection for operating personnel so as to prevent injury to such personnel, as well as to avoid pollution of the atmosphere.

Many different types of waste solvent disposal units have been provided but, for the most part, they are complex in construction and expensive to produce and maintain. Thus, a need exists for a waste solvent receptacle which is simple and rugged in construction, can be easily moved into and out of an operated position for receiving waste solvent, and which meets city and local codes. The present invention satisfies such need.

SUMMARY OF THE INVENTION

The present invention is directed to a waste solvent receptacle in which a waste tank is carried in an open-top, box-like container, with the waste tank having an inlet port for receiving waste solvent and, optionally, an outlet port for allowing disposal of the waste solvent therein by way of a pump or other means. The waste tank has level sensors which sense several levels of the solvent received therein.

The container which receives the waste tank has an open top and is larger in volume than the waste tank. Thus, the waste tank and the container define a space surrounding the waste tank when the waste tank is in the container. This space is used to receive and trap solvent from the waste tank if, for any reason, there is solvent leakage overflow. Thus, the waste tank assembly of the present invention provides a safety factor which provides protection to adjacent structural features, such as floors, to prevent structural damage while providing protection against injury to operating personnel.

The primary object of the present invention is to provide a waste tank assembly which is simple and rugged in construction, is safe to use and meets city and local codes relating to the handling of waste solvent.

Another object of the present invention is to provide a waste tank assembly of the type described wherein the assembly includes a waste tank removably placed within an open-top container in which the container has a volume greater than that of the waste tank so that a space is formed between the waste tank and container to receive leakage and overflow of solvent from the waste tank to prevent damage to adjacent structure and injury to operating personnel.

Other objects of this invention will become apparent as the following specification progresses, reference being had to the accompanying drawings for an illustration of the invention.

IN THE DRAWINGS:

FIG. 1 is a front elevational view of the solvent waste tank assembly of the present invention, showing the way in which the assembly is mounted below a sink for receiving waste solvent for disposal;

FIG. 2 is an enlarged, perspective view of the waste tank assembly with the waste tank and the open-top container thereof separated from each other;

FIG. 3 is a view similar to FIG. 2 but showing the waste tank in the container;

FIG. 4 is an end elevational view of the waste tank assembly;

FIG. 5 is a side elevational view of the waste tank assembly; and

FIG. 6 is a top plan view of the waste tank assembly.

The waste tank assembly or receptacle of the present invention is broadly denoted by the numeral 10 and is shown in detail in FIGS. 4, 5 and 6. Assembly 10 includes a waste tank 12 removably mounted in an open top container 14, and the waste tank 12 is adapted to receive waste solvents to be disposed of. The assembly 10 is suitable for a wide range of applications but, for purposes of illustration, it is used for receiving waste solvents from a sink 16 (FIG. 1) having an open top 18 and arranged in a hood or other frame structure 20 of any suitable design. The sink has a fluid outlet (not shown) in the bottom thereof.

Waste tank 12 is comprised of a hollow body having a top wall 22, a pair of spaced, parallel side walls 24, a pair of spaced, parallel end walls 26, and a bottom (not shown) spanning the distance between the lower margins of side walls 24 and end walls 26. The walls and bottom of waste tank 12 are formed from stainless steel, preferably 16-gauge 316 stainless steel so that the waste tank will resist corrosion when it contains any one of a member of different types of solvents. While a rectangular shape has been shown for waste tank 12, it can be of another shape, if desired.

Waste tank 12 is provided with a central inlet tube 28 surrounding a hole in top wall 22 to allow waste solvents to be directed into the waste tank 12 from above, such as by a pipe 30 leading downwardly from the drain outlet of sink 16 (FIG. 1). A clamp 32 with an O-ring seal 33 is provided for clamping the lower end of pipe 30 to inlet tube 28 and for forming a liquid-tight seal between tube 28 and pipe 30.

A second outlet tube 34 is provided near one corner of top wall 22 in surrounding relationship to a hole therein to provide access to the interior of the tank when the solvent wastes in the tank are to be pumped out of the waste tank. A cap (not shown) is provided for tube 34 when waste tank 12 is in place beneath a sink 16 as shown in FIG. 1. The cap is provided with an air hole to allow air to escape from the waste tank 12 as solvent wastes are directed into the tank. Similarly, tube 28 is provided with a cap with a hole in it to allow the tube 28 to be capped while solvent wastes are pumped out of the waste tank through outlet tube 34.

Container 14 is rectangular in shape and larger in size than waste tank 12 as shown in FIGS. 2–6. Container 14 includes a bottom 36, a pair of spaced, parallel side walls 38, and a pair of spaced, parallel end walls 40. The height of side walls 38 is less than that of side walls 24 of waste tank 12 so that the waste tank will project above the upper margin of the side and end walls 38 and 40 of container 14 as shown in FIGS. 3–5. The length of side walls 38 of container 14 is greater than the length of side walls 24 of waste tank 12, and the width of the end walls 40 is greater than the length of end walls 26. Thus, while waste tank 12 and container 14 have essentially the same shape, waste tank 14 is greater in size as shown in FIG. 6 to present a space surrounding waste tank 12 when the waste tank is in an operative position in the container and supported on the bottom 36 of the container as shown in FIGS. 3–6. The volume of container 14 is typically 110% (or greater) of the volume of waste tank 12.

Waste tank 12 is centered in position on the bottom 36 of container 14 by L-shaped brackets 48 which are secured in any suitable manner, such as by welding, to the upper surface of bottom 36. Top wall 22 of waste tank 12 is provided with a pair of inverted C-shaped handles 50 near the end walls 26 to allow the waste tank to be easily lifted out and to be easily placed into container 14.

A number of casters 42 are provided on the lower surface of container 14 to allow the container to be moved along with waste tank 12 away from and toward an operative position below a sink, such as sink 16 as shown in FIG. 1. Two of the four casters 42 typically are swiveling casters to allow directional changes of the container as the container is moved from one place to another.

Waste tank 12 is provided with a pair of liquid level sensors 52 and 54 which are located within the interior of the waste tank 12 at different levels therein. Sensor 52 is adapted to indicate and sense the level of the solvent when the solvent is approaching the upper, inner surface of the waste tank, and sensor 54 is adapted to sense when the solvent level is at the upper inner surface of the waste tank, i.e., when the tank is full and should receive no more solvent. The sensors are electrically controlled, and electrical leads 54 and 56 are coupled with the sensors and extend away from waste tank 12 to control means (not shown) which regulates the flow of solvent from sink 16 into the tank through pipe 30.

In use, waste tank assembly 10 is assembled such that waste tank 12, when empty, is placed in container 14, and the container is then moved into an operative position below a solvent discharge means, such as sink 16 as shown in FIG. 1. Then, pipe 30 is coupled to the fluid outlet of sink 16 and to waste tank inlet tube 28, using clamp 32 to couple the lower end of the pipe with the waste tank 12. The O-ring seal carried by the clamp provides a liquid-tight seal between inlet tube 28 and pipe 30. During the time in which waste solvent are directed into waste tank 12, outlet tube 34 is provided with a cap with a hole in it so that it can prevent removal of the solvent from the waste tank while allowing the escape of air therefrom as the tank receives solvent from the sink 16. If, for any reason, solvent leaks from tubes 28 and 34, such solvent will flow into container 14 and be trapped thereby. Thus, the leaking solvent will not spill onto the floor below the container.

The waste tank assembly 10 therefore provides a portable system which provides a safety factor to permit excess solvents leaking from or overflowing from waste tank 12 to be trapped by container 14. Also, the waste tank 12 sensors will sense the level of the liquids in the waste tank so that an operator can monitor the filling of the waste tank and stop the flow of solvent into the waste tank when the waste tank capacity has been reached. The waste tank assembly of the present invention meets semiconductor safety requirements of many city ordinances, notwithstanding its bulky carrier when the waste tank 12 is substantially filled with waste solvents.

I claim:

1. A waste solvent receptacle comprising:

a closed waste tank having a top provided with a solvent inlet port, said waste tank adapted to receive solvent through the port; and a mobile container having an open top, a fluid impervious bottom, and wall structure secured to and extending upwardly from said bottom, said waste tank being removably received in said container through said open top and being supported on said bottom, said waste tank top includes a top wall and means on the topwall thereof for defining a pair of handles on said waste tank to facilitate removal of said waste tank from said container, said container having a volume greater than the volume of the waste tank so that a space is formed in surrounding relationship to the waste tank and substantially surrounding a major portion of said waste tank when the waste tank is centrally located in the container, whereby the container can receive leakage and overflow solvent from the waste tank, said top wall having a solvent outlet port thereon and spaced from the inlet port thereof for pumping said solvent out of said waste tank and electrical level sensor means for controlling the solvent level within said waste tank.

2. A receptacle as set forth in claim 1, wherein the waste tank has means coupled therewith for sensing the level of solvent within the waste tank.

3. A receptacle as set forth in claim 1, wherein the container has bracket means on the bottom thereof for positioning the waste tank in a central, operative location in the container.

4. A receptacle as set forth in claim 1, wherein the waste tank is rectangular in configuration, said container being substantially complimental to the waste tank.

5. A receptacle as set forth in claim 1, wherein the waste tank has a pair of opposed, generally parallel side walls, a pair of opposed, generally parallel end walls, a bottom and a top wall, said container having a pair of opposed, generally parallel side walls, a pair of opposed, generally parallel end walls, and a bottom, the side and end walls of the waste tank being generally parallel with and spaced from respective side and end walls of the container when the waste tank is in the container.

6. A receptacle as set forth in claim 5, wherein the height of the side and end walls of the waste tank is greater than the height of the side and end walls of the container.

7. A receptacle as set forth in claim 5, wherein the top wall of the waste tank has a pair of handles thereon near respective end walls of the waste tank.

* * * * *